US009155370B2

(12) United States Patent
Pena

(10) Patent No.: US 9,155,370 B2
(45) **Date of Patent: *Oct. 13, 2015**

(54) FASTENING DEVICE

(76) Inventor: Rolando J. Pena, Skillman, NJ (US)

( * ) Notice: Subject to any disclaimer, the term of this patent is extended or adjusted under 35 U.S.C. 154(b) by 1122 days.

This patent is subject to a terminal disclaimer.

(21) Appl. No.: 12/550,513

(22) Filed: Aug. 31, 2009

(65) Prior Publication Data

US 2009/0320870 A1 Dec. 31, 2009

Related U.S. Application Data

(63) Continuation of application No. 11/084,053, filed on Mar. 18, 2005, now Pat. No. 7,581,547.

(60) Provisional application No. 60/563,653, filed on Apr. 20, 2004.

(51) Int. Cl.
*A45D 8/34* (2006.01)
*A45D 8/00* (2006.01)

(52) U.S. Cl.
CPC .. *A45D 8/34* (2013.01); *A45D 8/00* (2013.01); *A45D 2008/345* (2013.01)

(58) Field of Classification Search
CPC ..... A45D 8/00; A45D 8/34; A45D 2008/345
USPC ..... 132/275–279; 54/78
See application file for complete search history.

(56) References Cited

U.S. PATENT DOCUMENTS

| | | | | |
|---|---|---|---|---|
| 385,721 | A | | 7/1888 | Muntz |
| 971,519 | A | | 10/1910 | Brannen |
| D52,258 | S | | 8/1918 | Upton |
| 1,288,939 | A | * | 12/1918 | Lichtenstein ..... 2/308 |
| 1,338,858 | A | * | 5/1920 | De Los S Enriquez ..... 2/308 |
| 2,560,267 | A | | 7/1951 | Baker et al. |
| 2,649,097 | A | | 8/1953 | Chernack |
| 2,796,069 | A | | 6/1957 | Mooney, Jr. |
| 3,000,384 | A | | 9/1961 | Piers, Jr. |
| 3,542,041 | A | | 11/1970 | Mercorella |
| 3,604,145 | A | | 9/1971 | Zimmerman |
| 4,785,834 | A | | 11/1988 | Gonzalez |
| 4,892,110 | A | | 1/1990 | Harvie |
| 4,972,660 | A | * | 11/1990 | Black ..... 54/78 |
| 5,025,613 | A | * | 6/1991 | Connors ..... 54/78 |
| 5,056,538 | A | | 10/1991 | Matula |
| 5,293,884 | A | | 3/1994 | Chapman et al. |

(Continued)

OTHER PUBLICATIONS

"Smokey Mountain Trading—Biker Patches," Jun. 2002, product description from http:/www.smokeymountaintrading.com (3 pages).

(Continued)

*Primary Examiner* — Robyn Doan
(74) *Attorney, Agent, or Firm* — McCarter & English, LLP

(57) ABSTRACT

A fastening device that is adjustable in length and diameter and which is visually attractive is provided. The device can be easily positioned about a wearer's hair and fastened thereabout, and is resistant to creeping down a hair bundle. The device comprises a body component having first and second ends with end connectors thereon for connecting the first and second ends together to form a cylindrical shape that can be positioned about a hair bundle. A plurality of body components can be connected to each other to form a hair fastening device of a desired length. An end component can be attached to the body component, and can optionally be adjusted in diameter.

20 Claims, 9 Drawing Sheets

(56) References Cited

U.S. PATENT DOCUMENTS

| | | | | |
|---|---|---|---|---|
| D353,226 | S | 12/1994 | Nahoum | |
| 5,465,741 | A | 11/1995 | Dvorak | |
| 5,472,003 | A | 12/1995 | Frame et al. | |
| D372,338 | S | 7/1996 | Engel et al. | |
| 5,555,901 | A | 9/1996 | Camp, Jr. et al. | |
| 5,590,668 | A | 1/1997 | Macy | |
| 5,727,575 | A | 3/1998 | Rontal | |
| 5,730,161 | A | 3/1998 | Kohanek | |
| 5,878,756 | A | 3/1999 | Bilodeau | |
| 5,901,713 | A | 5/1999 | Mroczek | |
| 5,927,297 | A | 7/1999 | Cooper | |
| 6,041,792 | A | 3/2000 | Kennedy | |
| 6,142,159 | A | 11/2000 | Lloyd | |
| 6,260,555 | B1 | 7/2001 | Natvig | |
| 6,401,255 | B1 | 6/2002 | Douglas | |
| 6,425,405 | B1 | 7/2002 | McRoberts | |
| 6,439,242 | B1 | 8/2002 | Head et al. | |
| D509,625 | S | 9/2005 | Pena | |
| D594,598 | S | 6/2009 | Pena | |
| 7,581,547 | B2 * | 9/2009 | Pena | 132/275 |

OTHER PUBLICATIONS

"Tail Tuxedos," Mar. 2001, product description and instructions from http://www.tailtuxedos.com (6 pages).

"Tail Tamer Products," 1996, product description from http://tailtamer.com (3 pages).

"Hair Glove," 2002, product description and frequently asked questions from http://www.hairglovesport.com (5 pages).

Eurosport, Oct. 2002, p. 54, "The Hair Glove" ponytail holder from http://www.soccer.com (1 page).

Notice of Allowance dated Jul. 1, 2004, from U.S. Pat. No. D509,625 (12 pages).

Supplemental Notice of Allowability dated Mar. 4, 2005, from U.S. Pat. No. D509,625 (7 pages).

Office Action dated Apr. 6, 2007, from U.S. Pat. No. D594,598 (11 pages).

Office Action dated Jul. 16, 2007, from U.S. Pat. No. D594,598 (12 pages).

Office Action dated May 13, 2008, from U.S. Pat. No. D594,598 (10 pages).

Notice of Allowance dated May 21, 2009, from U.S. Pat. No. 7,581,547 (8 pages).

Office Action dated Aug. 12, 2008, from U.S. Pat. No. 7,581,547 (9 pages).

Office Action dated Nov. 21, 2007, from U.S. Pat. No. 7,581,547 (8 pages).

Notice of Allowance dated Sep. 14, 2007, from U.S. Pat. No. 7,581,547 (10 pages).

Office Action dated Mar. 12, 2007, from U.S. Pat. No. 7,581,547 (10 pages).

* cited by examiner

FASTENING DEVICE

RELATED APPLICATIONS

This application is a continuation of U.S. patent application Ser. No. 11/084,053, filed Mar. 18, 2005, now U.S. Pat. No. 7,581,547, which claims the benefit of U.S. Provisional Application Ser. No. 60/563,653 filed Apr. 20, 2004, the entire disclosures of which are expressly incorporated herein by reference.

BACKGROUND OF THE INVENTION

1. Field of the Invention

The present invention relates to a fastening device. More specifically, the present invention relates to a fastening device for fastening and maintaining a bundle of, for example, hair.

2. Related Art

Fastening devices for holding a bundle of strands or the like are well known in the art. Examples of hair fastening devices include barrettes, pins, clips, claws, and combs, which are positioned onto a wearer's hair to retain the hair in a desired configuration. Another example of a hair fastener is the so-called "scrunchee" which is formed of a stretchable material and can be wrapped about a bundle of hair. Further, scrunchees and barrettes are often used to retain the wearer's hair in a ponytail.

A particular problem with existing hair fastening devices is that most are not adjustable in length and cannot easily accommodate varying hair lengths. Further, existing devices often have a uniform shape and/or diameter, even though the thickness of a wearer's ponytail decreases as it extends away from the head. Such uniform diameter, coupled with the rigidity of the prior devices, causes the devices to creep down the ponytail and to eventually fall off.

Accordingly, what would be desirable, but has not yet been provided, is a fastening device that is adjustable in length and diameter, and particularly, a hair fastening device that is visually attractive, can be easily positioned about a wearer's hair and fastened thereabout, and is resistant to creeping down a bundle of hair.

SUMMARY OF THE INVENTION

The present invention relates to a fastening device that is adjustable in length and diameter, and more specifically to a hair fastening device that is visually attractive, can be easily positioned about a wearer's hair and fastened thereabout, and is resistant to creeping down a bundle of hair. The device comprises a body component having first and second ends with end connectors thereon for joining the first and second ends together to form a cylindrical shape that can be positioned about a bundle of hair. Component connectors can be provided between the first and second ends to allow additional body components to be attached thereto. A plurality of body components can be connected to each other to form a hair fastening device of a desired length. Optionally, an end component can be provided, the end component including first and second ends with end connectors thereon for connecting the ends together to form a cylindrical shape about a bundle of hair, and a component connector between the first and second ends for attaching the end component to a body component. Optionally, the body component can be adjusted in diameter to accommodate bundles of hair of various sizes. Likewise, optionally, the end component can be adjusted in diameter to accommodate bundles of hair of various sizes.

In an embodiment of the present invention, a hair fastening device is provided and includes a plurality of body components having successively decreasing diameters. Each of the body components include first and second ends with end connectors thereon for joining the first and second ends together to form a cylindrical shape about a bundle of hair. Component connectors on each body component allow any desired number of body components to be connected together to form a device of a desired length. The successively decreasing diameters of the body components prevent the hair fastening device from creeping down the wearer's hair. Optionally, an end component can be provided having first and second ends with end connectors thereon for connecting the ends together to form a cylindrical shape about a bundle of hair, and a component connector between the first and second ends for attaching the end component to a body component.

The present invention further provides a method of fastening strands into a bundle. The method for fastening hair into a bundle includes the steps of providing a body component, placing the first body component in contact with a hair bundle, and attaching first and second ends of the first body component together to form a cylinder which surrounds the hair bundle. The method may further include the step of attaching an end component to a body component, positioning an end component in contact with a hair bundle, and attaching the ends of the end component together about a hair bundle.

The present invention also provides a method of fastening hair into a bundle including the steps of providing a plurality of body components, connecting the plurality of body components together to form a hair fastening device of a desired length, placing the hair fastening device in contact with a bundle of hair, and connecting together ends of each of the plurality of body components to form cylinders which surround the hair bundle. Optionally, the method may include the step of attaching an end component to the last body component and connecting ends of the end component to form a cylinder around the hair bundle.

The present invention can be applied to bundle objects other than hair, such as cables, wires, cords, and the like, using one or more body components and, optionally, an end component. Additionally, the present invention can be used to cover or conceal an object, such as a pipe, tube, or other similar object. Any desired number of components can be interconnected to accommodate a desired length, and the components positioned about the object and ends of the components fastened together to conceal the object.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a fastening device that is adjustable in length and diameter, and more specifically to a hair fastening device that is visually attractive, can be easily positioned about a wearer's hair and fastened thereabout, and is resistant to creeping down a hair bundle. The device comprises a body component having first and second ends with end connectors thereon for connecting the first and second ends together to form a cylindrical shape that can be positioned about a hair bundle. Component connectors can be provided between the first and second ends to allow additional body components to be attached thereto. A plurality of body components can be connected to each other to form a hair fastening device of a desired length. Optionally, the plurality of body components can have successively smaller diameters to prevent the hair fastening device from creeping down a hair bundle. An end component can be provided, including first and second ends with end connectors thereon for connecting the ends together to form a cylindrical shape about a bundle of hair, and a component connector between the first and second ends for attaching the end component to a body component. Optionally, the body component can be adjusted in diameter to accommodate bundles of hair of various sizes. Likewise, optionally, the end component can be adjusted in diameter to accommodate bundles of hair of various sizes.

Figure 1:
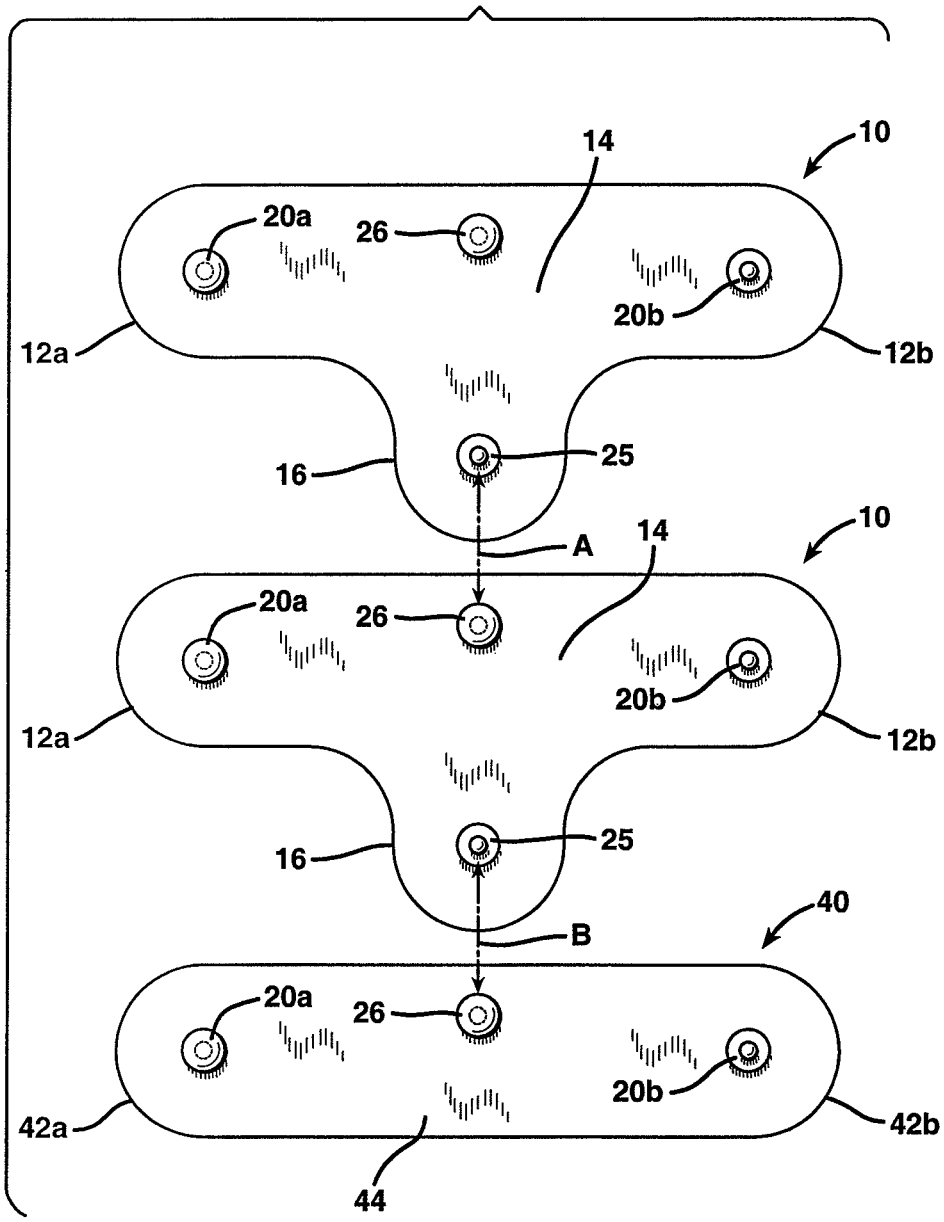
FIG. 1 shows components of the hair fastening device of the present invention.

FIG. 1 shows the hair fastening device of the present invention. The hair fastening device includes two body components, indicated generally at 10, and an end component, indicated generally at 40. Each of the body components 10 include first and second ends 12*a*, 12*b*, intermediate portions 14 between the ends 12*a*, 12*b*, and tabs 16 depending from the intermediate portions 14. End connectors 20*a*, 20*b* are provided on the ends 12*a*, 12*b*, respectively, of the body components 10, and allow the ends 12*a*, 12*b* to be connected together so that the body components 10 form a cylindrical shape about a wearer's hair. The words fasteners, attachments, connectors, and the like used herein are meant to describe any known or hereafter developed attachments and connectors. Similarly, it should be understood that such components, fasteners, attachments, and the like could comprise male and female connectors. For example, the end connectors 20*a*, 20*b* could be complementary male and female connectors of a snap or other connector, or alternatively, could be any other suitable connector such as a hook, button, hook-and-loop type fastener, etc.

Each of the body components 10 include component connectors 25, 26 for allowing any desired number of body components to be joined together to form a hair fastening device of a desired length. Similar to the end connectors 20*a*, 20*b*, the component connectors 25, 26 could comprise snaps, hooks, buttons, hook-and-loop type fasteners, or any other suitable connectors for joining the body components 10 together. Preferably, the component connectors 25, 26 are complementary male and female connectors forming a snap, and are attached to each body component 10 along a substantially vertical axis extending along an intermediate portion 14 of each body component 10. A male connector could be provided on one component, and a female connector could be provided on another component, and vice versa. As shown by arrow A, first and second body components 10 can be joined together by mating component connector 25 on tab 16 of a first body component with component connector 26 on intermediate portion 14 if a second body component. Any suitable number of successive body components can be connected together in this fashion to form a hair fastening device of a desired length. Preferably, the connections formed between the attached components allow the body components to pivot from side to side with respect to each other. This allows the entire device to bend and/or move more naturally with movement of the wearer's hair.

Optionally, an end component 40 can be provided and attached to a body component 10. The end component 40 includes first and second ends 42*a* and 42*b*, and an intermediate portion 44 therebetween. End connectors 20*a*, 20*b* are provided on the ends 42*a*, 42*b* of end component 40. By interconnecting end connectors 20*a* and 20*b*, the ends 42*a*, 42*b* of the end component can be joined together to form the end component into a cylinder for extending about a bundle of hair. The end connectors 20*a*, 20*b* could be complementary male and female connectors of a snap, or alternatively, could be any suitable connector such as a hook, button, and hook-and-loop type fastener. The end component 40 also includes a component connector 26 for connecting with component connector 25 of body component 10, as shown by arrow B. As with the body components 10, the end component 40 can also swivel from side to side.

The body and end components 10 and 40 of the hair fastening device of the present invention can be manufactured of any suitable flexible or semi-rigid material. Examples of such materials include, but are not limited to, leather, imitation leather, denim, neoprene and plastic. Further, the inner surfaces of the body and end components 10 and 40 can include a high-friction material, such as a gel material, to allow the entire hair fastening device to grip a wearer's hair. This further prevents the hair fastening device from creeping down a wearer's hair during use.

Figure 2:
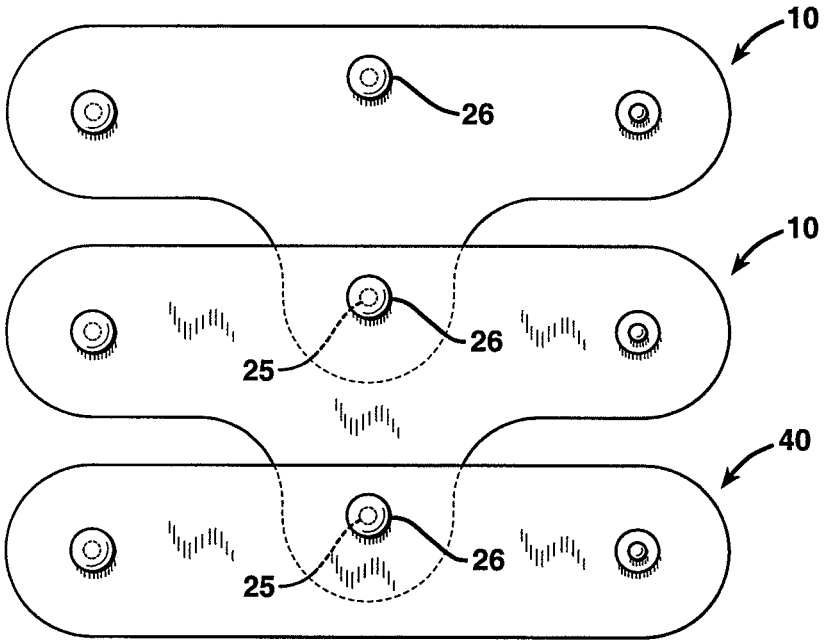
FIG. 2 shows the components of FIG. 1 attached together.

FIG. 2 shows the components of the hair fastening device of FIG. 1 connected together. Body components 10 are attached together by component connectors 25 and 26. Likewise, end component 40 is attached to a body component 10 by component connectors 25 and 26. The connections formed by connectors 25, 26 allow the components to swivel with respect to each other, so that the hair fastening device can accommodate movement of a wearer's hair. It should be noted that the connectors 25 and 26 could even be made permanent, using a rivet or the like, if desired. If a rivet or other similar permanent connection is utilized, preferably such connection also allows the components to swivel.

Figure 3A:
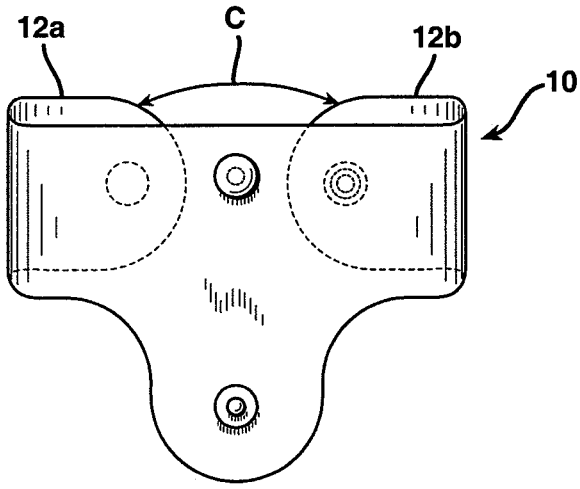
FIG. 3A shows the ends of a component of FIG. 1 partially formed into a cylinder.
Figure 3B:
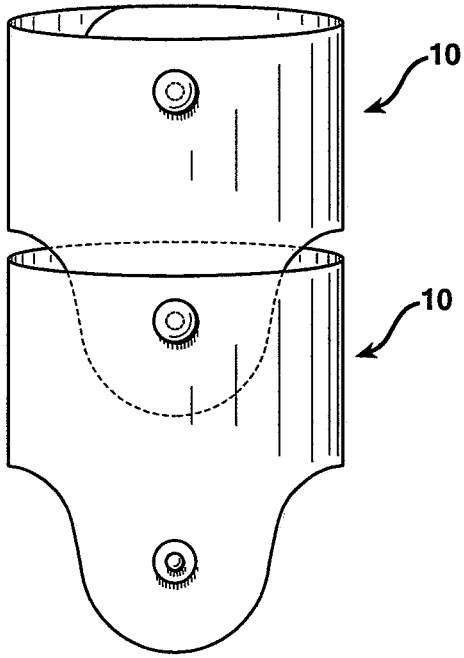
FIG. 3B shows two components of FIG. 1 attached together and formed into a cylinder.

As shown in FIG. 3A, when the ends 12*a* and 12*b* of body component 10 are brought together about a bundle of hair in the general direction indicated by arrow C, and are attached to each other, the body component 10 forms a cylindrical shape. As shown in FIG. 3B, successive body components 10 can be connected together, and the cylindrical shape extended for any desired length.

Figure 4A:
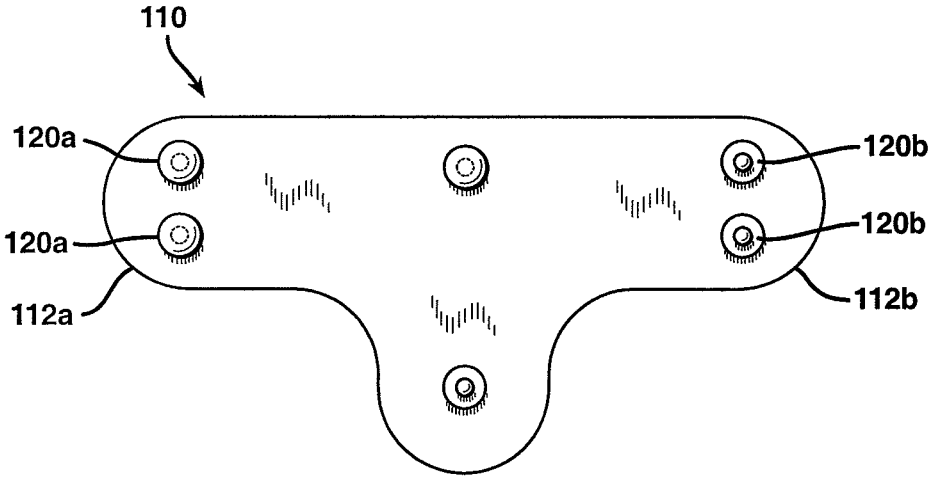
FIGS. 4A and 4B show alternate embodiments of the components shown in FIG. 1.
Figure 4B:
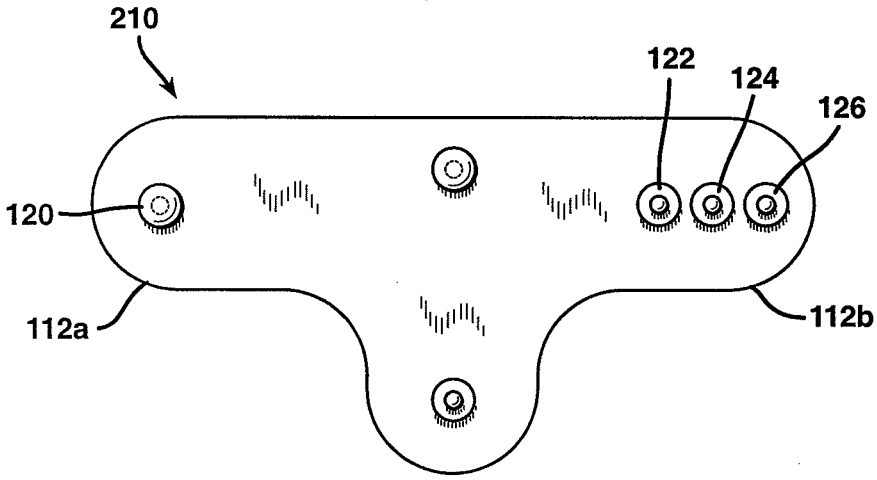

FIGS. 4A and 4B show alternate embodiments of the present invention, wherein a number of end connectors are provided on the ends of the body components. FIG. 4A shows a body component 110 having two end connectors 120*a* on a first end 112*a*, and two complementary end connectors 120*b* on an opposite end 112*b*. Such an arrangement provides a more secure attachment of the ends 112*a* and 112*b* about a hair bundle, which is especially advantageous for thick hair. Additionally, as shown in FIG. 4B, a single end connector 120 could be provided on a first end 112*a*, and a number of complementary end connectors 122, 124, and 126 could be provided on opposite end 112*b* to allow for various diameters when the end connector 120 is mated with any of the end connectors 122, 124, and 126. Such an arrangement can accommodate hair bundles of varying thicknesses, as well as different thickness along the length of the bundle.

Figure 5:
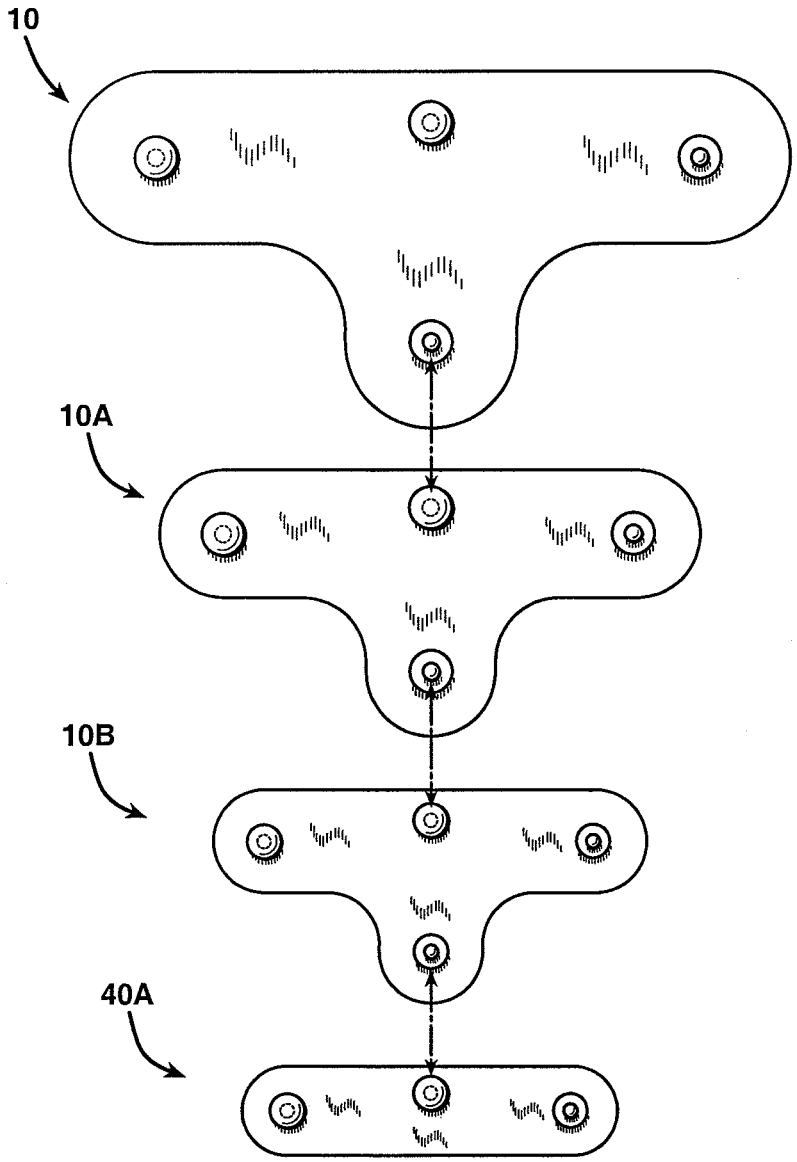
FIG. 5 shows the components of a hair fastening device.

FIG. 5 shows the hair fastening device of the present invention, wherein a plurality of body components of successively decreasing size are provided. As shown therein, each of the body components 10, 10*a*, and 10*b* are successively smaller in size, and the end component 40 is smaller than the body component 10*b*. The body components and end component can be connected together in the manner described herein. The configuration shown in FIG. 5 allows the hair fastening device of the invention to accommodate a hair bundle of decreasing thickness as the bundle extends away from the head. Further, the successively decreasing sizes of the components prevent the device from creeping down a bundle of hair when in use.

Figure 6:
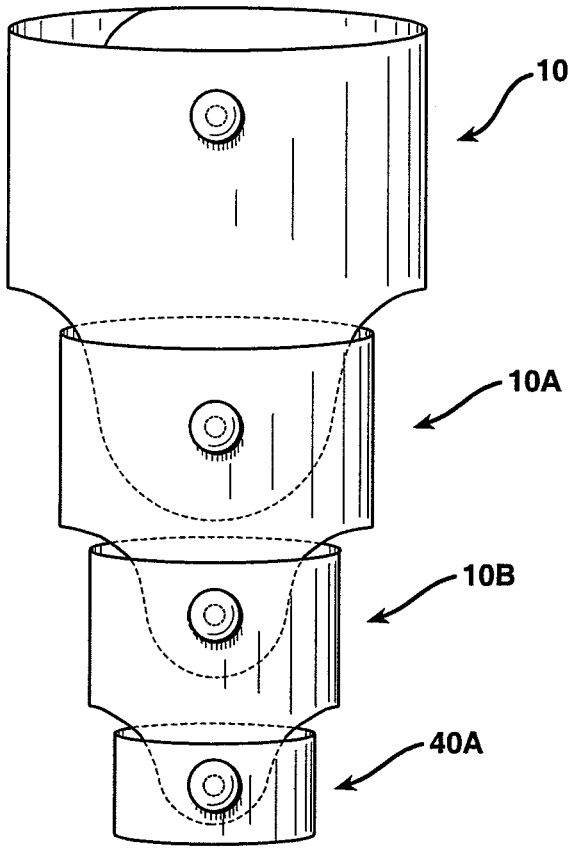
FIG. 6 shows the components of FIG. 5 attached together and formed into cylinders.

As shown in FIG. 6, after the components of FIG. 5 have been attached together, they can be formed into cylinders of successively smaller diameters about a bundle of hair. As mentioned earlier, any desired number of components can be utilized to provide a hair fastening device of any length.

Figure 7:
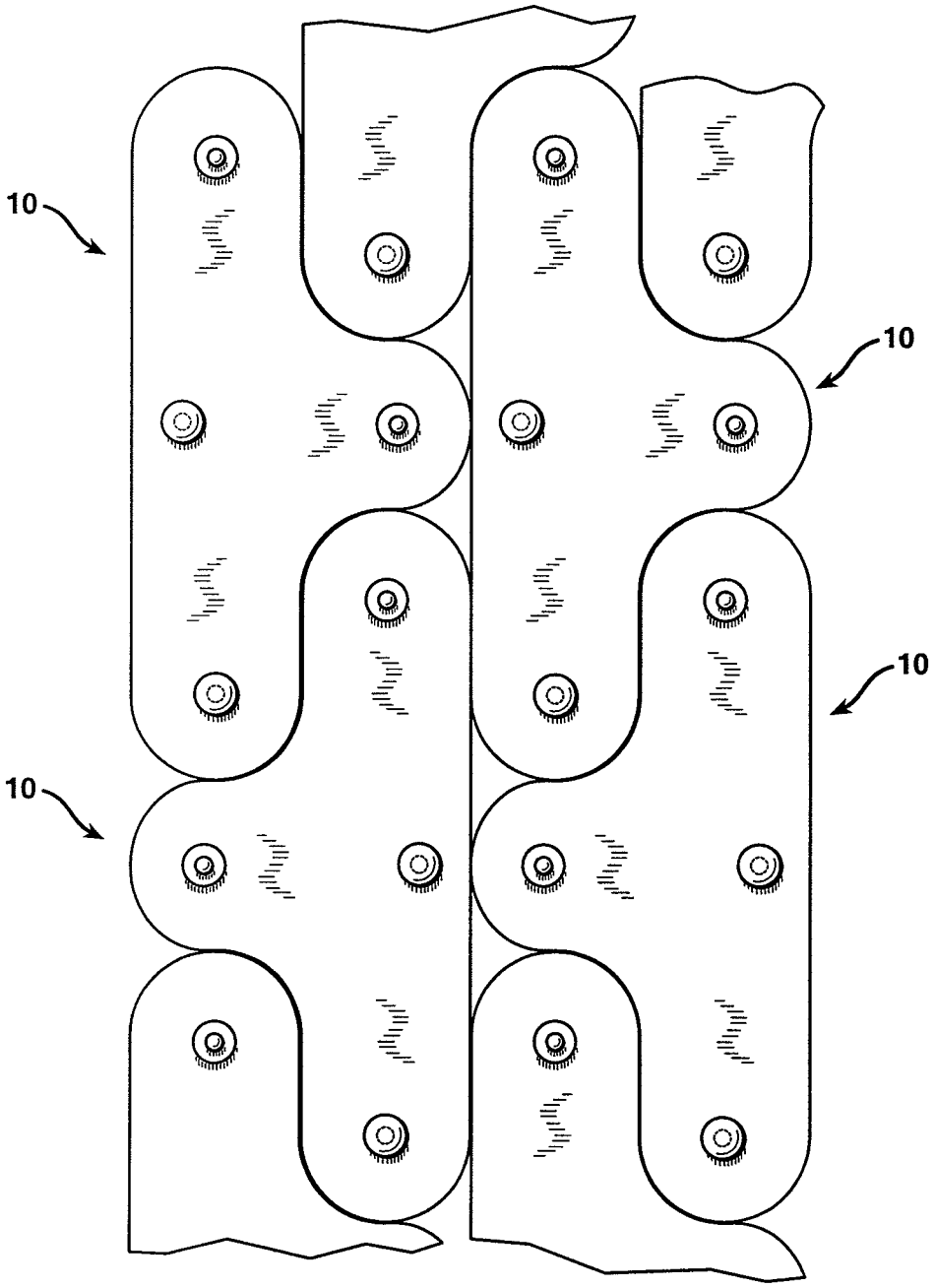
FIG. 7 shows the components of a device of the present invention laid out on a sheet.

The components of the hair fastening device of the invention may be conveniently manufactured from a single sheet of material, to minimize manufacturing waste. The layout for such a sheet is shown in FIG. 7. Each of the components 10 can be cut from the sheet using any suitable cutting process. The connectors shown in FIG. 7 could be attached to the sheet prior to cutting out individual components 10.

Figure 8:
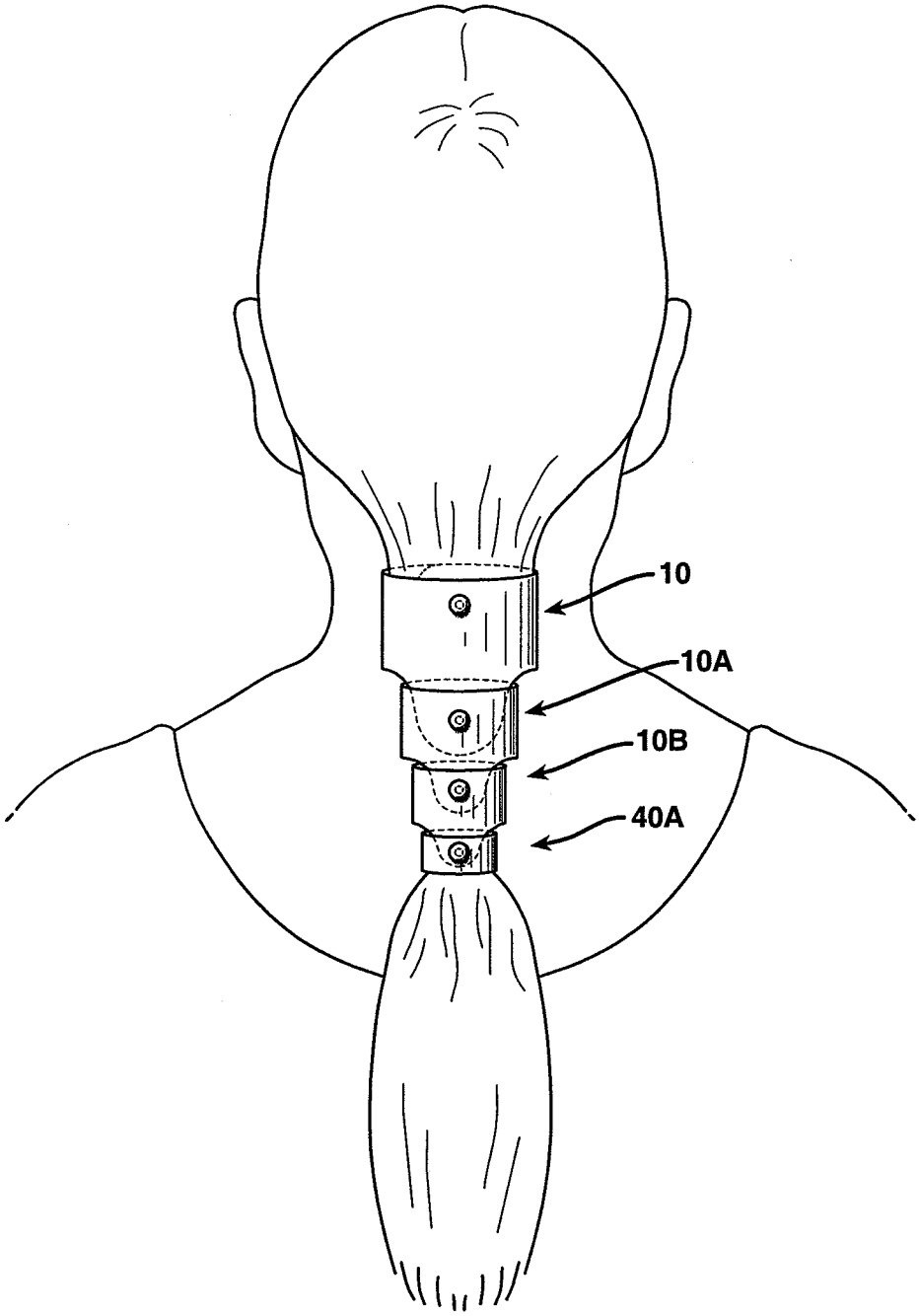
FIG. 8 shows the hair fastener device of the present invention in use.
Figure 9:
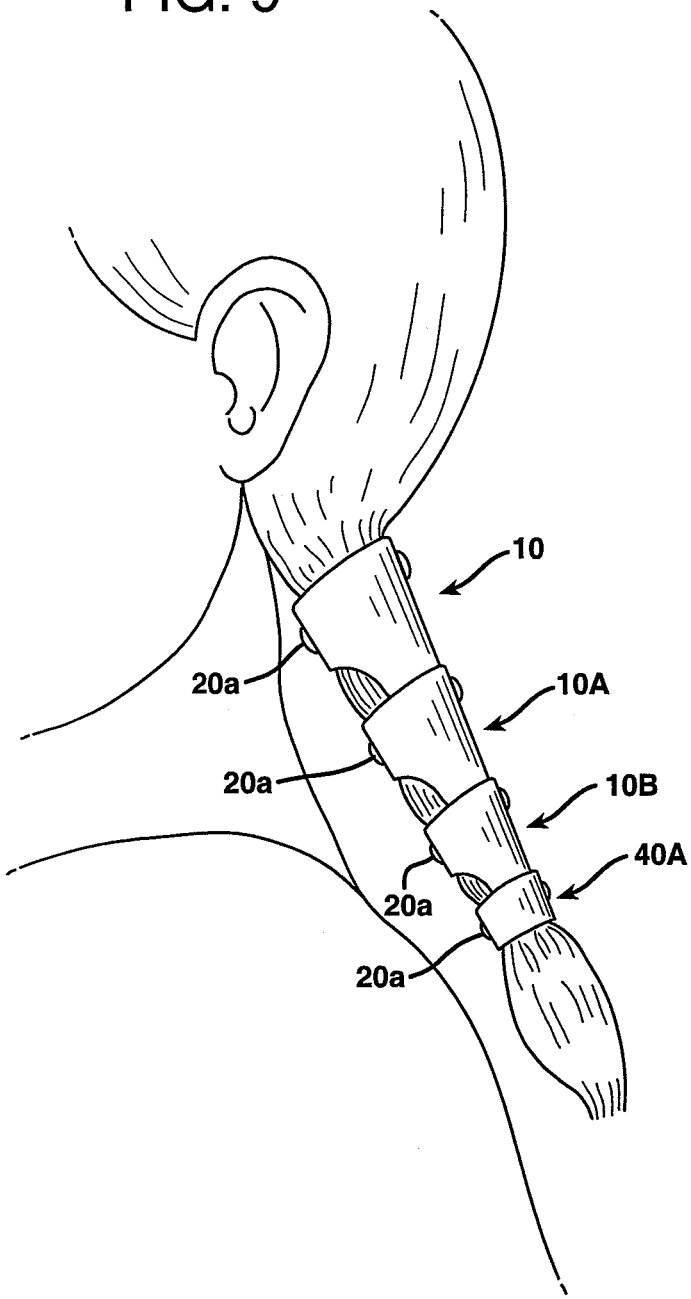
FIG. 9 is a side view of the hair fastener device shown in FIG. 8.

FIGS. 8 and 9 show the hair fastening device of the invention in position on a wearer's ponytail. Three body components 10, 10*a*, and 10*b*, and one end component 40*a*, are shown interconnected together and formed into cylinders about the ponytail. The components have successively smaller sizes along the length of the ponytail, thereby preventing the device from creeping down the ponytail during use. Any desired number of components can be provided. As shown in FIG. 9, the attachments 20*a* of the components 10, 10*a*, 10*b*, and 40*a* are visible.

The present invention can be used for applications other than bundling hair. For example, the present invention could be used to bundle cables, wires, cords, or other similar objects, using one or more of the body components and, optionally, an end component. Further, the present invention could be used for covering or concealing a pipe, tube, and other object, wherein any desired number of body components can be interconnected together to accommodate a desired length, and the components positioned about the object and ends of the components connected together to conceal the object.

Having thus described the invention in detail, it is to be understood that the foregoing description is not intended to limit the spirit and scope thereof. What is desired to be protected by Letters Patent is set forth in the appended claims.

What is claimed is:

1. A hair fastening device comprising:

a body component having first and second ends and a tab extending downwardly from and formed integrally in one piece with the body component;

end connectors on the first and second ends for connecting the ends together to form the body component into a cylindrical shape about a bundle of hair;

a component connector on the tab of the body component for attaching an additional component to the body component; and another body component connected to the body component, where the body components swivel with respect to each other.

2. The hair fastening device of claim 1, further comprising a second component connector positioned on the body component intermediate the end connectors on the body component.

3. The hair fastening device of claim 1, further comprising an end component connected to the body component.

4. The hair fastening device of claim 3, wherein the end component comprises a component connector for connecting the end component to the body component.

5. The hair fastening device of claim 4, wherein the component connector is positioned on an intermediate portion of the end component.

6. The hair fastening device of claim 4, wherein the end component comprises end connectors on first and second ends of the end component for connecting the ends together to form a cylindrical shape about a bundle of hair.

7. The hair fastening device of claim 4, wherein the end component swivels with respect to the body component.

8. The hair fastening device of claim 3, wherein the end component further comprises a plurality of end connectors for adjusting the diameter of the end component.

9. The hair fastening device of claim 1, wherein the body component further comprises a plurality of end connectors for adjusting the diameter of the body component.

10. A hair fastening device comprising:

a plurality of interconnected body components formable into cylinders and positionable about a bundle of hair, each of the plurality of body components including a tab extending downwardly from and formed integrally in one piece with a body component, each tab including a component connector for interconnecting each of the plurality of body components;

an end component connected to one of the plurality of body components, the end component formable into a cylinder and positionable about a bundle of hair; and second component connectors positioned intermediate of the end connectors on the body components, wherein the component connectors allow each of the plurality of body components to swivel with respect to each other.

11. The device of claim 10, wherein each of the plurality of body components further comprises first and second ends having end connectors thereon for attaching the first and second ends together to form cylinders.

12. The device of claim 10, wherein the end component further comprises first and second ends having end connectors thereon for attaching the first and second ends together to form cylinders.

13. The device of claim 10, further comprising a second component connector between the end component and one of the plurality of body components.

14. The device of claim 13, wherein the component connectors allow the end component to swivel with respect to one of the plurality of body components.

15. The device of claim 10, wherein each of the plurality of body components and the end component are adjustable in diameter.

16. The device of claim 10, wherein the plurality of body components have successively smaller sizes.

17. The device of claim 16, wherein the end component is smaller than the plurality of body components.

18. A method of fastening hair into a bundle comprising:

providing a body component having first and second ends with end connectors thereon, a tab extending downwardly from and formed integrally with the body component, and a component connector on the tab for attaching an additional component to the body component;

placing the body component in contact with a bundle of hair; and attaching the end connectors of the first and second ends of the body component together to form a cylinder about the bundle of hair.

19. The method of claim 18, further comprising:

providing an intermediate component having first and second ends with end connectors thereon;

placing the intermediate component in contact with the bundle of hair;

attaching the intermediate component to the component connector on the tab of the body connector; and attaching the first and second ends of intermediate component together to form a second cylinder about the bundle of hair.

20. The method of claim 19, further comprising:

providing an end component having first and second ends with end connectors thereon;

placing the end component in contact with the bundle of hair;

attaching the end component to the intermediate component; and attaching the first and second ends of the end component together to form an end cylinder about the bundle of hair.

* * * * *